US007601901B2

(12) United States Patent
Payerl

(10) Patent No.: US 7,601,901 B2
(45) Date of Patent: Oct. 13, 2009

(54) MUSICAL INSTRUMENT, IN PARTICULAR A CAJON

(75) Inventor: Wolfgang Payerl, Neustadt/Aisch (DE)

(73) Assignee: Roland Meinl Musikinstrumente GmbH & Co. KG, Neustadt/Aisch (DE)

( * ) Notice: Subject to any disclaimer, the term of this patent is extended or adjusted under 35 U.S.C. 154(b) by 0 days.

(21) Appl. No.: 11/854,438

(22) Filed: Sep. 12, 2007

(65) Prior Publication Data

US 2009/0013849 A1 Jan. 15, 2009

(30) Foreign Application Priority Data

Jul. 11, 2007 (DE) ..... 10 2007 032 204

(51) Int. Cl.
*G10D 13/02* (2006.01)

(52) U.S. Cl. ..... 84/411 R

(58) Field of Classification Search ..... 84/411 R
See application file for complete search history.

(56) References Cited

U.S. PATENT DOCUMENTS

| | | | | | |
|---|---|---|---|---|---|
| D100,734 | S | * | 8/1936 | Lira | D17/22 |
| 3,705,527 | A | * | 12/1972 | Burnham | 84/403 |
| 3,756,114 | A | * | 9/1973 | Bontempi | 84/453 |
| 3,911,778 | A | * | 10/1975 | Martin | 84/267 |
| 4,026,185 | A | * | 5/1977 | Migirian | 84/411 R |
| 4,137,815 | A | * | 2/1979 | Kloc | 84/408 |
| D267,014 | S | * | 11/1982 | Migirian | D17/22 |
| D296,447 | S | * | 6/1988 | Jowitt | D17/22 |
| 5,385,075 | A | * | 1/1995 | Carnes et al. | 84/411 R |
| 2008/0034944 | A1 | * | 2/2008 | Aspland | 84/415 |
| 2008/0083317 | A1 | * | 4/2008 | Payerl | 84/411 R |
| 2009/0013849 | A1 | * | 1/2009 | Payerl | 84/411 R |

OTHER PUBLICATIONS

Fat Congas, "Cajon, Cajon Drums, Congas," © 2006, cajones of various shapes, no screws at corners, viewed Oct. 8, 2008 at www.fatcongas.com on Oct. 8, 2008.*

Sol Cajon Drums, round box wooden drums the height of congas, © 2001 Sol Percussion, soldrums.com/cajon.html?rhythmweb, viewed Oct. 8, 2008.*

Cajon, Origins and Evolution, Wikipedia, background and history of the Cajon, viewed Oct. 8, 2008 at en.wikipedia.org/wiki/Cajon.*

German Ocana, "How to Build Flamenco Cajon with Plywood," © 2004, http://www.ocanartesania.com/V2/pdf/articulos/building_cajon.pdf viewed Aug. 10, 2008.*

* cited by examiner

*Primary Examiner*—Jeffrey Donels
*Assistant Examiner*—Robert W Horn
(74) *Attorney, Agent, or Firm*—Browdy and Neimark, P.L.L.C.

(57) ABSTRACT

In the case of a musical instrument, in particular a cajón, with a basic element, the side faces of which are configured as striking faces, provision is made for a striking face to be convexly and ergonomically curved.

3 Claims, 1 Drawing Sheet

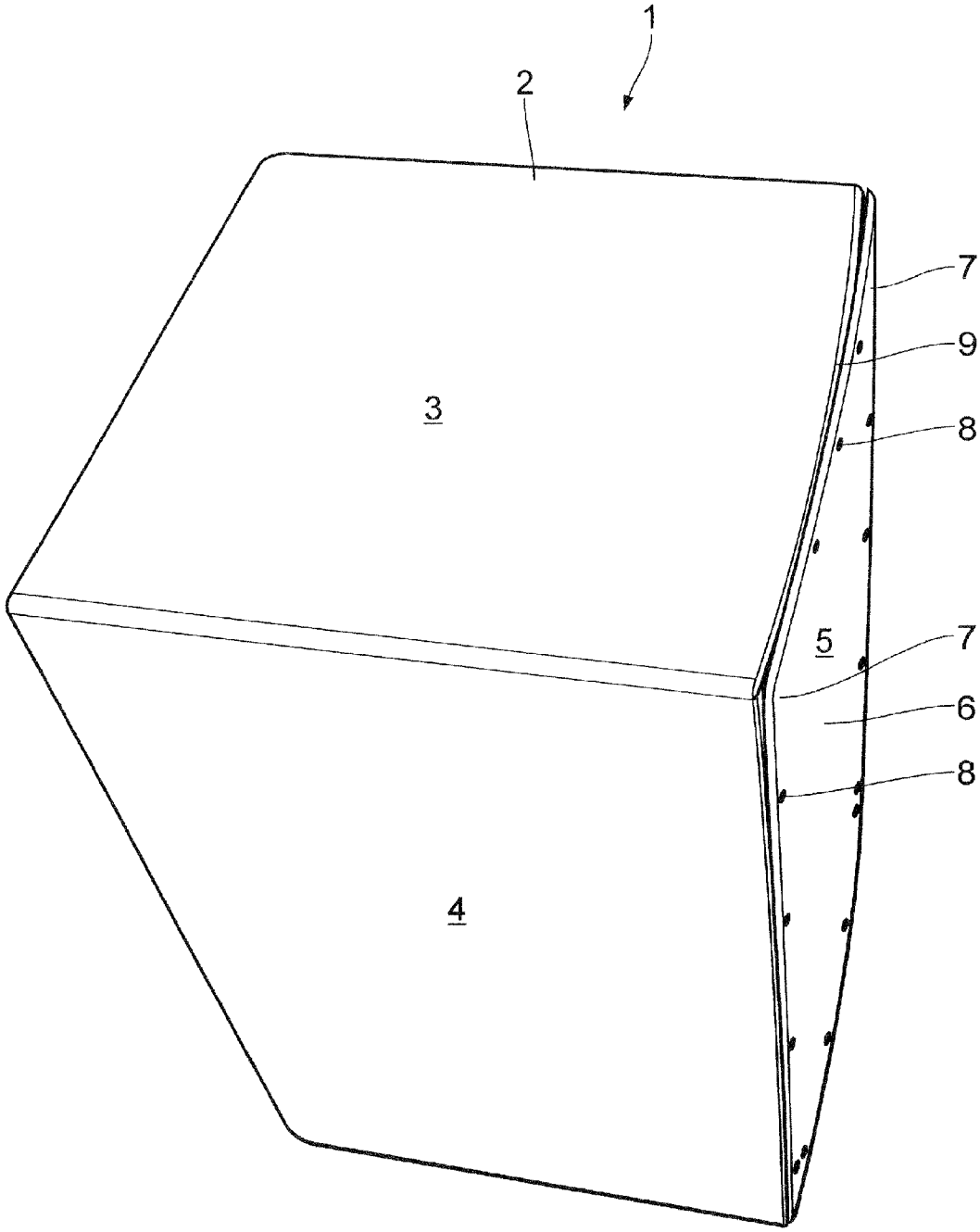
1
2
3
4
5
6
7
7
8
8
9

MUSICAL INSTRUMENT, IN PARTICULAR A CAJON

BACKGROUND OF THE INVENTION

1. Field of the Invention

The invention relates to a musical instrument, in particular a cajón, with an approximately cuboid basic element, the side faces of which are configured as striking faces.

2. Background Art

The basic element of a musical instrument of this type is normally assembled from panels, for example wood panels. In order to obtain special sound effects it is known to provide inside the basic element in the region of the striking face what are known as snare-effect devices or other tone generating and altering arrangements.

SUMMARY OF THE INVENTION

Starting from here the object of the invention is to develop a musical instrument, in particular a cajón, of the aforementioned type, so that on the one hand new sound effects are created and a prominent, distinctive appearance is also achieved.

This object is achieved according to the invention in that the striking face is configured in a convexly curved manner.

In this respect provision is made in particular for the upper and lower end walls to be configured in a curved manner in the fixing region of the striking face, in order to thus curve the striking face attached thereto.

By means of the configuration according to the invention, an extended frequency spectrum is achieved by increased tension of the front panel, a better slapping effect is achieved by having a greater distance between the front panel and the main body and increased comfort whilst playing is achieved by the ergonomic shape of the front panel.

Preferably the striking face is fixed to the upper and lower end walls as well as to both sides by screws, rivets, glue or the like.

Provision is made in particular for no such fixing elements to be provided in the upper corner regions of the striking face so that these corner regions stand away slightly from the upper end wall due to the curvature.

Thus it is possible to play the centre of the striking face or alternatively the upper outer edge regions. Conventionally the sound achieved by playing the edge regions is different from that achieved when playing the centre. Due to the configuration according to the invention these edge regions may stand away slightly and may correspondingly oscillate freely, so that a further modified sound is achieved.

The invention will be described in greater detail hereinafter with reference to a preferred embodiment in conjunction with the drawing.

BRIEF DESCRIPTION OF THE DRAWING

The FIGURE shows a perspective view obliquely from above of a cajón according to the invention.

DESCRIPTION OF THE PREFERRED EMBODIMENT

A cajón 1 as shown in the drawing comprises a substantially cuboid basic element 2 with an upper end wall 3 which serves as a sitting face, with a lower end wall which is not shown in the drawing and serves as a base panel, with a back wall, also not shown in the drawing, with side walls 4 and a front striking face 5 which the player plays with his or her hands whilst sitting on the sitting face or end wall 3.

The striking face 5 comprises a central striking region 6 and upper edge regions 7.

The striking face 6 is screwed to the basic element 2 by screws 8, the top panel 3 and the base panel comprising convexly curved edges 9. The screws 8 are fixed along these edges, but preferably not on the upper edge regions 7 of the striking face 6, so that these edge regions 7 project slightly from the basic element 2.

As a result, the sound created by striking these edge regions 7 differs considerably from that created by striking the central region 6 of the striking face 5.

What is claimed is:

1. A musical instrument, comprising:

a basic body comprising a hollow, cuboid shape for making a percussive sound when struck and a striking face for playing the musical instrument, wherein the striking face is a vertically oriented, convexly curved surface and includes an upper corner region(s) and a fixing region, the fixing region is adjacent to the upper corner region(s) and along an upper end edge of the striking face, the basic body includes a lower end wall, an upper end wall, and side surfaces, and the upper end wall has a convexly curved edge connected only to the fixing region(s), so that the upper corner region slightly stands away from the upper end wall.

2. The musical instrument in claim 1, wherein the striking face further comprises a lower end edge, and two side surface edges, the upper corner region comprises two upper corner edges, the fixing region comprises a centre portion of the upper end edge between the upper corner edges, and the striking face and the basic body are connected by spot fixing elements disposed space apart from one another along the centre portion of the upper edge and are not disposed in the upper corner edges.

3. The musical instrument in claim 2, wherein the spot fixing elements further connect the striking face and the basic body along the lower edge and the side surfaces, the lower edge comprises two lower corner edges.

* * * * *